US006044246A

United States Patent [19]

Tashiro et al.

[11] Patent Number: 6,044,246

[45] Date of Patent: Mar. 28, 2000

[54] SHEET ACCOMMODATING APPARATUS AND COMPLEX IMAGE FORMING SYSTEM USING SAME

[75] Inventors: Osamu Tashiro, Osaka; Itsuro Kato, Nara, both of Japan

[73] Assignee: Sharp Kabushiki Kaisha, Osaka, Japan

[21] Appl. No.: 09/130,292

[22] Filed: Aug. 6, 1998

[30] Foreign Application Priority Data

Aug. 6, 1997 [JP] Japan ..... 9-212244

[51] Int. Cl.[7] ..... G03G 15/00; G03G 21/00; B65H 39/07

[52] U.S. Cl. ..... 399/410; 399/403; 399/407; 270/12; 270/58.01

[58] Field of Search ..... 399/410, 407, 399/408, 403; 270/12, 1.01, 58.01, 58.23

[56] References Cited

U.S. PATENT DOCUMENTS 4,727,402 2/1988 Smith .
5,385,340 1/1995 Hiroi et al. .

FOREIGN PATENT DOCUMENTS 01043457A of 0000 Japan .
02086498A of 0000 Japan .
03266644A of 0000 Japan .
08217306A of 0000 Japan .
54047659A of 0000 Japan .
57029059A of 0000 Japan .
8-9451 of 0000 Japan .
8-258352 10/1996 Japan .

*Primary Examiner*—Richard Moses
*Attorney, Agent, or Firm*—Dike, Bronstein, Roberts & Cushman, LLP; David G. Conlin

[57] ABSTRACT

An object of the invention is to accommodate sheets, as coming from two image forming units, in a small-sized sheet accommodating apparatus. The individual sheets S from the first and second image forming units are fetched in different directions X1 and Y1 by a sheet pedestal and accommodated in a stack. The sheets S are registered by stoppers which can be moved in the fetching directions X1 and Y1, respectively. The sheets can be fetched in registration by inclining the sheet pedestal into first and second modes and can be fetched in an image forming direction and in a sheet direction by turning at least the sheet pedestal in a horizontal direction. The sheets S are stapled as the post-processing and are discharged in a discharge direction X2 along the fetching direction X1 from the sheet pedestal by a push member.

22 Claims, 10 Drawing Sheets

SHEET ACCOMMODATING APPARATUS AND COMPLEX IMAGE FORMING SYSTEM USING SAME

BACKGROUND OF THE INVENTION

1. Field of the Invention

The present invention relates to a sheet accommodating apparatus, which is applied to a post-processing apparatus for post-processing or stapling sheets discharged from an image forming unit, especially for accommodating the sheets discharged from two image forming units, and to a complex image forming system which is equipped with the sheet accommodating apparatus.

2. Description of the Related Art

FIG. 12 is a diagram showing a prior art image forming system 100. This image forming system 100 is constructed by jointing a single post-processing apparatus 102 to a single image forming unit 101. The post-processing apparatus 102 once fetches and accommodates sheets discharged from the image forming unit 101, and post-processes and discharges the sheets. The post-processing apparatus is exemplified by that which has been disclosed in Japanese Examined Patent Publication JP-B2 8-9451(1996). This post-processing apparatus accommodates the sheets, as discharged from the single image forming unit, and staples them.

As the image forming unit, on the other hand, there have been known in the prior art a copying machine according to an electrophotographic method, a printer, a facsimile apparatus and a printing machine. At present, however, there has been generalized an image forming system in which there are combined a copying image forming unit and an image forming unit for forming an image with image signals coming from a computer or the like. In this complex image forming system, the individual image forming units are made independent of one another due to the image qualities, the image signals, the image forming costs and the image forming and processing speeds. The post-processing apparatus can be connected to each of the image forming units.

To the complex image forming system, on the other hand, there can be connected a multi-function sheet discharge apparatus which has been disclosed in Japanese Unexamined Patent Publication JP-A 8-217306(1996). This multi-function sheet discharge apparatus accommodates the individual sheets, as discharged from a plurality of image forming units, and discharges them in a predetermined sequence. To this complex image forming system, there can be further connected a post-processing apparatus through such multi-function sheet discharge apparatus.

In the complex image forming system, the individual image forming units are made independent of one another. On the other hand, the post-processing apparatus, as disclosed in JP-B2 8-9451(1996), is designed to fetch the sheets from the single image forming unit so that it cannot fetch the sheets from a plurality of image forming units. As a result, the post-processing apparatus is connected to each image forming unit so that the sheets from the individual image forming units are fetched and accommodated by the individual post-processing apparatus connected thereto. Thus, the post-processing apparatus has to be connected to each of the image forming units so that the sheet accommodation portion in the post-processing apparatus is complicated to enlarge the size of the apparatus. In order to post-process the sheets from the individual image forming units altogether, moreover, the sheets from the individual post-processing apparatus have to be further processes, and these works are troublesome for the operator.

To the complex image forming system, on the other hand, there is connected the multi-function sheet discharge apparatus which has been disclosed in JP-A 8-217306. In this case, too, the sheets from the individual image forming units of the complex image forming system are fetched and accommodated like before in the individual accommodation portions of the multi-function sheet discharge apparatus. As a result, the plural sheet accommodation portions are required to enlarge the size of the apparatus.

SUMMARY OF THE INVENTION

An object of the invention is to provide a small-sized sheet accommodating apparatus capable of accommodating sheets from two image forming units. Another object of the invention is to provide a complex image forming system equipped with the sheet accommodating apparatus.

The invention provides a sheet accommodating apparatus comprising a sheet accommodation portion for fetching sheets which are discharged from a first image forming unit, in one direction, and for fetching sheets which are discharged from a second image forming unit, in another direction different from the one direction.

According to the invention, the individual sheets from the first and second image forming units are both fetched in the different directions by the sheet accommodation portion. As a result, the sheet accommodation portion need not be provided for each image forming unit so that the sheet accommodating apparatus can be small-sized.

Furthermore the sheet accommodating apparatus is characterized in that the sheet accommodation portion accommodates a plurality of sheets in a stack.

According to the invention, the sheets which are fetched by the sheet accommodation portion are stacked and accommodated. As a result, the accommodating area of the sheet accommodation portion can be designed to be substantially equal to the area of a single sheet thereby to reduce the size of the sheet accommodating apparatus.

Furthermore the sheet accommodating apparatus is characterized in that the one fetching direction and the another fetching direction are perpendicular to each other.

According to the invention, the directions, in which the individual sheets from the first and second image forming units are fetched by the sheet accommodation portion, are selected to intersect each other at right angles. When the sheets from the individual image forming units are rectangular, they can be accommodated in registration by selecting the fetching directions, as described above.

Furthermore, the sheet accommodating apparatus further comprises:

one registration member arranged in a direction perpendicular to the one fetching direction; and the other registration member arranged in a direction perpendicular to the another fetching direction, wherein both of the one and other registration members are arranged so as to protrude from a sheet placing face of the sheet accommodation portion.

According to the invention, the sheets from the first image forming unit are registered by the one registration member whereas the sheets from the second image forming unit are registered by the other registration member, so that all the sheets thus fetched can be registered and accommodated to improve the sheet registration.

Furthermore, the sheet accommodating apparatus further comprises moving means for moving the one registration member in the one fetching direction and the other registration member in the another fetching direction.

According to the invention, the one registration member is moved in the direction to fetch the sheets from the first image forming unit, and the other registration member is moved in the direction to fetch the sheets from the second image forming unit, so that the sheets can be registered according to their sizes.

Furthermore, the sheet accommodating apparatus further comprises discharge means for discharging the accommodated sheets from the sheet accommodation portion.

According to the invention, the accommodated sheets are discharged from the sheet accommodation portion by the discharge means so that new sheets from the image forming unit can be fetched and accommodated after the discharge thereby to repeat the sheet accommodating and discharging actions.

Furthermore, the sheet accommodating apparatus is characterized in that the discharge means includes a sheet push member arranged so as to protrude from the sheet placing face of the sheet accommodation portion and to be movable in the one or another fetching direction.

According to the invention, the accommodated sheets are easily discharged from the sheet accommodation portion by pushing them with the sheet push member constituting the discharge means. A sheet discharging direction is either the fetching direction of the sheets from the first image forming unit or the fetching direction of the sheets from the second image forming unit so that the apparatus space can be effectively exploited by aligning the sheet fetching direction and the sheet discharging direction from and to the sheet accommodation portion.

Furthermore, the sheet accommodating apparatus further comprises inclination means for inclining the sheet accommodation portion.

According to the invention, the sheets from the image forming unit can be registered and accommodated by inclining the sheet accommodation portion.

Furthermore, the sheet accommodating apparatus is characterized in that the inclination means can incline the sheet accommodation portion into a first or second mode, the first mode being an inclination mode in which the downstream side end portion, as taken in the one fetching direction, is at a higher level than the upstream side end portion, and the second mode being an inclination mode in which the downstream side end portion, as taken in the another fetching direction, is at a higher level than the upstream side end portion.

According to the invention, the sheet accommodation portion can be inclined into the first and second modes so that the sheets can be registered and accommodated in the sheet accommodation portion at the side of the first or second image forming unit.

Furthermore, the sheet accommodating apparatus further comprises an inclination switching circuit for switching the inclination of the sheet accommodation portion by the inclination means between the first and second modes in accordance with the discharging actions of the sheets from the first and the second image forming units.

According to the invention, when the sheets from the first image forming unit are to be fetched, the sheet accommodation portion is inclined into the first mode so that the sheets can be registered and accommodated in the sheet accommodation portion at the side of the first image forming unit. When the sheets from the second image forming unit are to be fetched, the sheet accommodation portion is inclined into the second mode so that the sheets can be registered and accommodated in the sheet accommodation portion at the side of the second image forming unit.

Furthermore, the sheet accommodating apparatus further comprises turning means for turning at least the sheet accommodation portion of the sheet accommodating apparatus in a horizontal direction.

According to the invention, by turning at least the sheet accommodation portion in the horizontal direction, the individual sheets from the first and second image forming units can be accommodated such that they are registered in their image forming directions and in their own directions.

Furthermore, the sheet accommodating apparatus is characterized in that the turning means turns at least the sheet accommodation portion by 90 degrees.

According to the invention, when the fetching direction of the sheets from the first image forming unit and the fetching direction of the sheets from the second image forming unit are perpendicular to each other, the sheets can be accommodated with the image forming direction of the images formed on the individual sheets and the sheet directions being aligned, if at least the sheet accommodation portion is turned by 90 degrees.

Furthermore, the sheet accommodating apparatus further comprises a turning direction switching circuit for switching a turning direction of at least the sheet accommodation portion by the turning means, in accordance with the discharging actions of the sheets from the first and the second image forming units.

According to the invention, the turning directions can be switched between the fetch of the sheets from the first image forming unit and the fetch of the sheets from the second image forming unit, so that the turning distance can be shortened. Thus, the individual sheets from the first and second image forming units can be efficiently fetched and accommodated in a continuous manner with the image forming directions and the sheets directions being aligned.

Furthermore, the sheet accommodating apparatus further comprises post-processing means for post-processing the sheets, as accommodated in the sheet accommodation portion, in a predetermined manner.

According to the invention, the sheets, as accommodated in the sheet accommodation portion, can be post-processed. After this post-processing, the sheets are discharged from the sheet accommodation portion.

Furthermore, the sheet accommodating apparatus is characterized in that the post-processing apparatus means is a stapler for stapling the sheets accommodated in the sheet accommodation portion.

According to the invention, the accommodated sheets can be stapled as the post-processing.

Furthermore, there is provided a complex image forming system comprising:

first and second image forming units for forming images on predetermined sheets and for discharging the sheets; and a sheet accommodating apparatus according to any one of the aforementioned aspects.

According to the invention, it is possible to realize a complex image forming system comprising the aforementioned sheet accommodating apparatus. According to this system, it is possible to fetch and accommodate the sheets which have images formed by different image forming units.

Furthermore, the complex image forming system is characterized in that the first image forming unit is provided over on an upper portion of a side face thereof with an exit for discharging the sheets having the formed images, the second image forming unit is provided in the upper face thereof with an exit for discharging the sheets having the formed images, the first image forming unit has a height selected to be larger than that of the second image forming unit, and the second image forming unit is arranged at the side having the exit of the first image forming unit whereas the sheet accommodating apparatus is arranged over the second image forming unit.

According to the invention, by constructing the complex image forming system, as described above, the sheets from each image forming unit can be fetched with a small space to reduce the size of the system.

Furthermore, the complex image forming system is characterized in that the first image forming unit forms a monochromatic image whereas the second image forming unit forms a color image.

According to the invention, it is possible to fetch and accommodate both the sheets having the monochromatic image formed by the first image forming unit and the sheets having the color image formed by the second image forming unit.

Furthermore, the complex image forming system is characterized in that the first image forming unit is realized by an analog type electrophotographic copying machine whereas the second image forming unit is realized by a digital type laser beam electrophotographic color printer.

According to the invention, the monochromatic image is formed by using the analog type electrophotographic copying machine as the first image forming unit, and the color or monochromatic image is formed with image signals from a computer or the like by using the digital type laser beam electrophotographic color printer as the second image forming unit, so that both the sheets having those images can be fetched and accommodated. This complex image forming system is excellent in the image qualities and the image forming efficiencies and can be realized at a relatively low cost.

Furthermore, the complex image forming system is characterized in that the first image forming unit is realized by an analog type electrophotographic copying machine whereas the second image forming unit is realized by a printing type printer.

According to the invention, the monochromatic image is formed by using the analog type electrophotographic copying machine as the first image forming unit, and the color or monochromatic image is formed with image signals from a computer or the like by using the printing type color printer as the second image forming unit, so that both the sheets having those images can be fetched and accommodated. This complex image forming system is excellent in the image qualities and the image forming efficiencies and can be realized at a relatively low cost.

Furthermore, the complex image forming system is characterized in that the first image forming unit is realized by a digital type electrophotographic copying machine whereas the second image forming unit is realized by a printing type color printer.

According to the invention, the monochromatic image is formed by using the digital type electrophotographic copying machine as the first image forming unit, and the color or monochromatic image is formed with image signals from a computer or the like by using the printing type color printer as the second image forming unit, so that both the sheets having those images can be fetched and accommodated. This complex image forming system is excellent in the image qualities and the image forming efficiencies and can be realized at a relatively low cost.

Furthermore, the complex image forming system is characterized in that the first image forming unit forms an image with image signals read thereby, and the image signals read by the first image forming unit are fed to the second image forming unit so that the second image forming unit forms an image with the image signals.

According to the invention, the digital type electronic photographic copying machine or the first image forming unit is given an image reading function and forms a monochromatic image with the image signals read thereby, and the second image forming unit forms a monochromatic image with the Image signals read by the first image forming unit. As a result, the second image forming unit can form the image, if not connected with a computer or the like, so that the system construction can be simplified.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
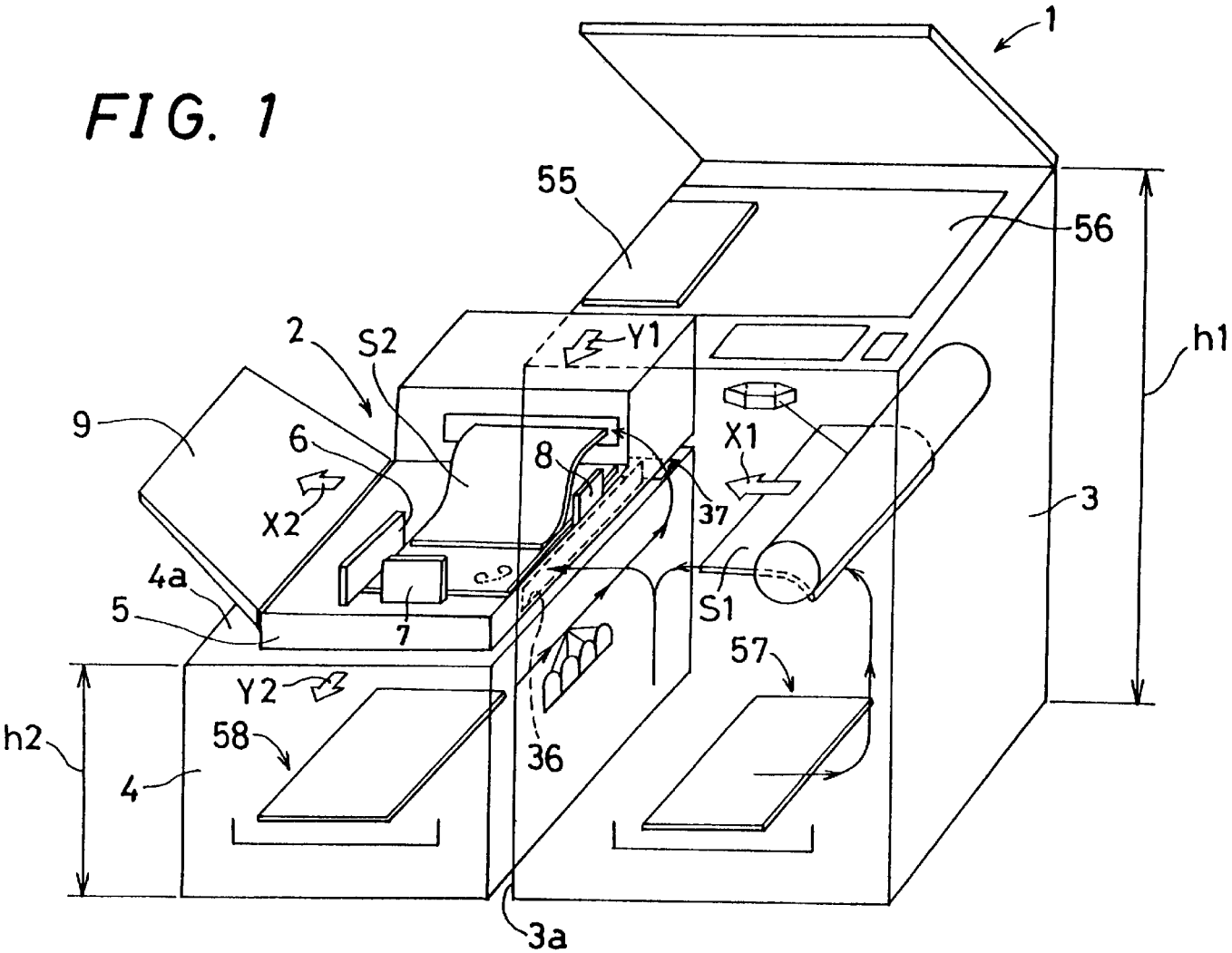
FIG. 1 is a perspective view showing a complex image forming system 1 according to one embodiment of the invention.

Now referring to the drawings, preferred embodiments of the invention are described below.

Figure 2:
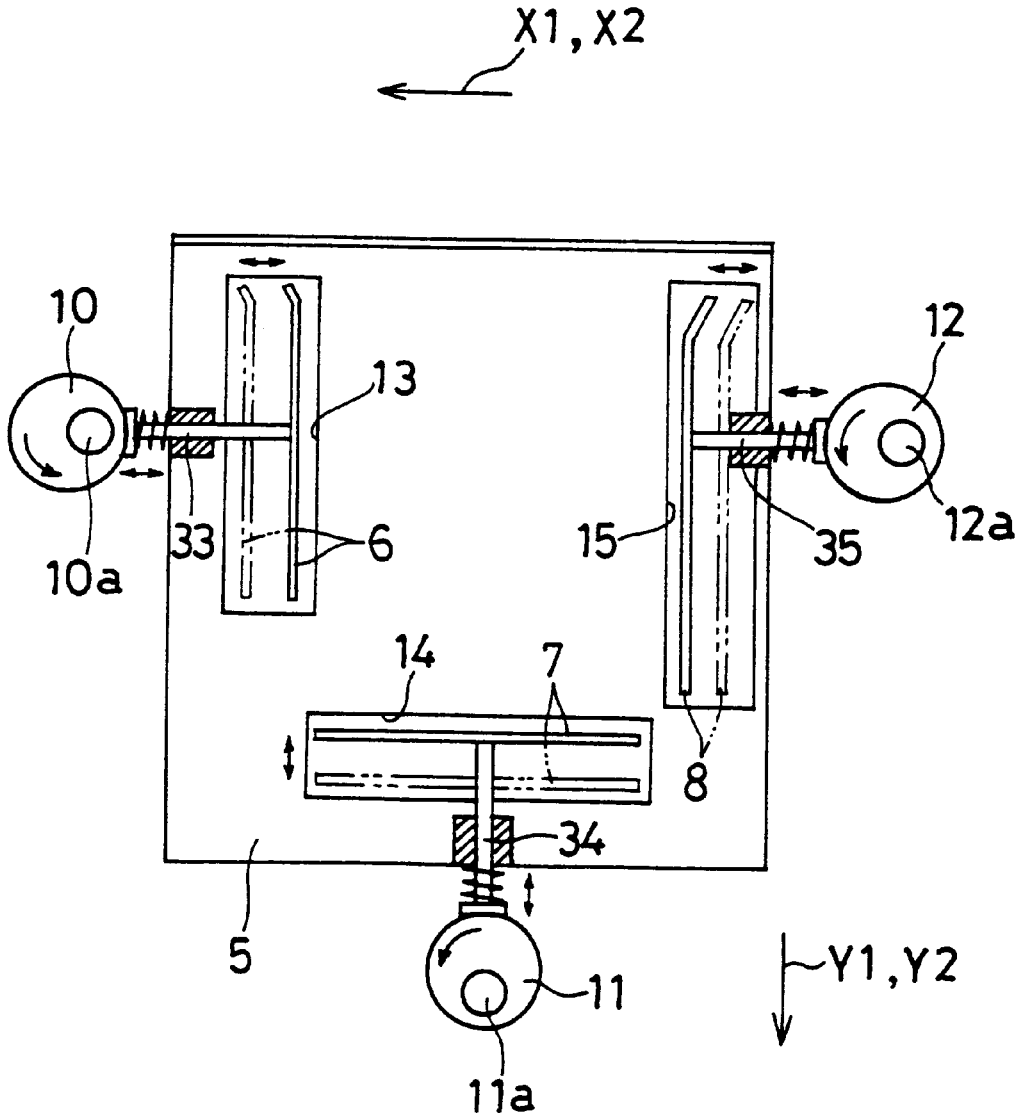
FIG. 2 is a top plan view showing moving mechanisms for stoppers 6 and 7 and a push member 8, which belong to a post-processing apparatus 2 of the complex image forming system 1.
Figure 3:
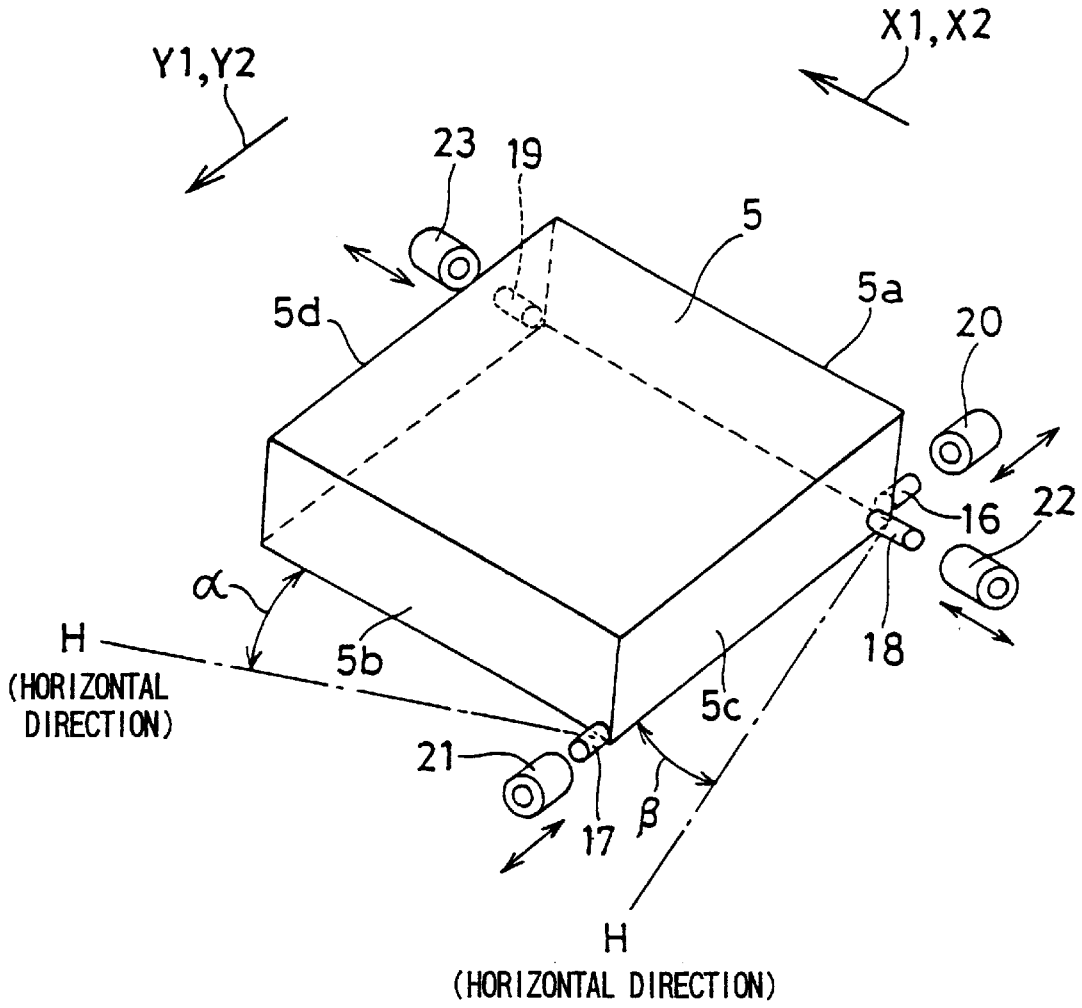
FIG. 3 is a perspective view showing an inclining mechanism for a sheet pedestal 5 belonging to the post-processing apparatus 2.
Figure 4:
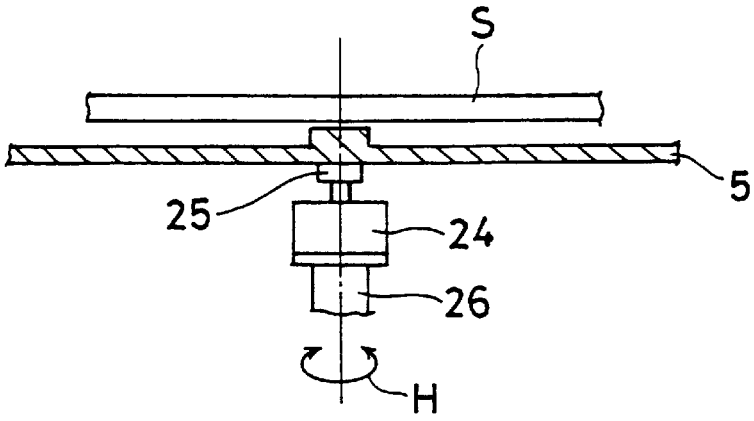
FIG. 4 is a section showing a turning mechanism for the sheet pedestal 5.
Figure 5:
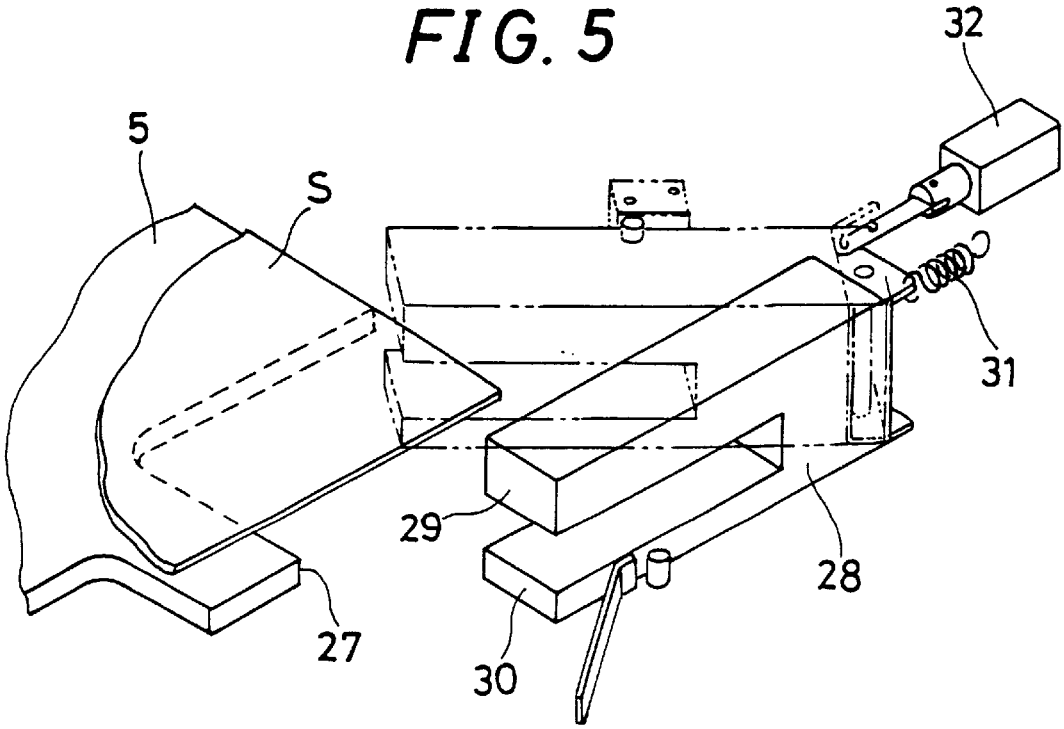
FIG. 5 is a perspective view showing a staple mechanism belonging to the post-processing apparatus 2.

FIG. 1 is a perspective view showing a complex image forming system 1 according to one embodiment of the invention; FIG. 2 is a top plan view showing moving mechanisms for stoppers 6 and 7 and a push member 8, which belong to a post-processing apparatus 2 of the complex image forming system 1; FIG. 3 is a perspective view showing an inclining mechanism for a sheet pedestal 5 belonging to the post-processing apparatus 2; FIG. 4 is a section showing a turning mechanism for the sheet pedestal 5; and FIG. 5 is a perspective view showing a staple mechanism belonging to the post-processing apparatus 2. The complex image forming system 1 is constructed to include the post-processing apparatus 2, which is equipped with a sheet accommodating apparatus according to the invention. The post-processing apparatus 2 fetches and accommodates sheets S1, as discharged from a first image forming unit 3, and sheets S2, as discharged from a second image forming unit 4.

Figure 6A:
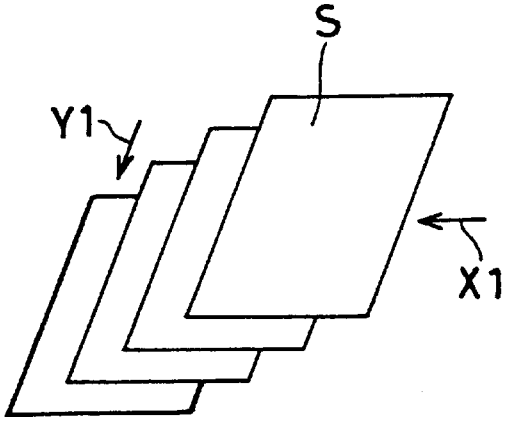
FIGS. 6A and 6B are diagrams for explaining sheet introducing and discharging actions.
Figure 6B:
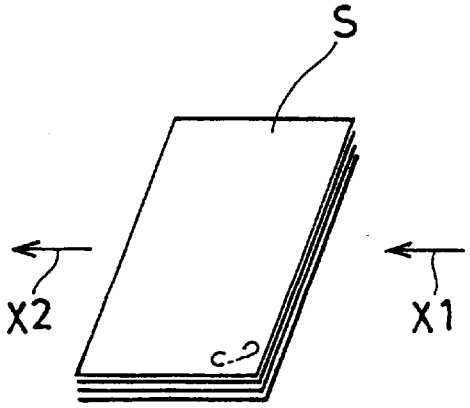

In relation to the post-processing apparatus 2, there is provided the sheet pedestal 5 forming the sheet accommodation portion for fetching and accommodating the individual sheets S1 and S2 (as will be generally designated by reference numeral S). Moreover, a direction X1, in which the sheets S1 are fetched from the first image forming unit 3, and a direction Y1, in which the sheets S2 are fetched from the second image forming unit 4, are selected different. Since the sheets in these different fetching directions X1 and Y1 are fetched by the single sheet pedestal 5, no different sheet pedestals 5 need be individually provided for the image forming units 3 and 4 so that the sheet accommodation portion can be small-sized. Especially in this embodiment, the rectangular sheets S are discharged from the individual image forming units 3 and 4, and the fetching directions X1 and Y1 are selected perpendicular to each other. As a result, the individual sheets S can be accommodated in registration. The sheets S coming in the individual fetching directions X1 and Y1 are stacked and accommodated on the sheet pedestal 5, as shown in FIG. 6A, and are stapled by the later-described stapling mechanism, as shown in FIG. 6B, until they are discharged in a discharge direction X2 in parallel with the fetching direction X1 from the sheet pedestal 5. Since the plural sheets S are accommodated in the stack, the stacking area of the sheet pedestal 5 can be designed to be substantially equal to the area of a single sheet so that the sheet accommodation portion can be small-sized.

In relation to the post-processing apparatus 2, the stoppers 6 and 7 protruded from the sheet pedestal 5 are provided as registration members for registration the fetched sheets S. The stoppers 6 and 7 are shaped into flat plates, for example, and one stopper 6 is arranged in a direction perpendicular to the fetching direction X1 whereas the other stopper 7 is arranged in a direction perpendicular to the fetching direction Y1. The sheets S1 from the first image forming unit 3 are registered in abutment against the stopper 6 whereas the sheets S from the second image forming unit 4 are registered in abutment against the stopper 7. Thus, all the sheets S can be accommodated in registration. The stoppers 6 and 7 are made movable, as will be described in the following. Specifically, the stopper 6 can be moved in the fetching direction X1 whereas the stopper 7 can be moved in the fetching direction Y1, so that the registering positions can be adjusted according to the sheet sizes.

In relation to the post-processing apparatus 2, moreover, there is provided discharge means for discharging the accommodated sheets S from the sheet pedestal 5. In this embodiment, the push member 8 which constitutes the discharge means, and is given a relatively simple construction but can easily discharge the sheets S by a simple control, is provided so as to protrude from the sheet pedestal 5. Like the stoppers 6 and 7, the push member 8 is shaped into a flat plate, for example, and is so arranged in a direction perpendicular to the discharge direction X2 that it can be moved in the direction X2, as will be described in the following. The sheets S are pushed and discharged in the discharge direction X2 by a tray 9. By thus conveying the sheets, new sheets S can be fetched, after discharged, from the image forming units 3 and 4 and accommodated to repeat the sheet accommodating and discharging actions. Since the sheet fetching direction X1 and the discharge direction X2 are aligned, the sheets S can be discharged with neither any mechanism for changing the sheet conveying direction nor any spare passage.

Here, the push member 8 may be arranged in a direction which is perpendicular to a discharge direction Y2 parallel to the fetching direction Y1, and may be made movable in the direction Y2 to push the sheets S in the discharge direction Y2. Alternatively, the sheets S may be pushed in the discharge directions X2 and Y2 and pushed out by selecting one of the directions.

The moving mechanisms for the stoppers 6 and 7 and the push member 8 will be described with reference to FIG. 2. This moving mechanisms can be exemplified by the mechanism which has been disclosed in Japanese Unexamined Patent Publication JP-A 54-47659(1979). FIG. 2 is a top plan view taken from the back (as opposed to the placing face) of the sheet pedestal 5. The moving mechanisms for the stoppers 6 and 7 and the push member 8 can be likewise constructed. An abutment 33, as extended from the stopper 6, is in abutment against the cam face of a cam 10 which has a shorter diameter portion and a longer diameter portion around a shaft 10*a*. The stopper 6 is reciprocated in the fetching direction X1 by transmitting the drive force of a stepping motor or the like to the shaft 10*a* through gears to rotate the cam 10. When the abutment member 33 abuts against the shorter diameter portion, the stopper 6 is arranged inside of the sheet pedestal 5. When the abutment member 33 abuts against the longer diameter portion, the stopper is arranged outside of the sheet pedestal 5.

Likewise, an abutment member 34, as extended from the stopper 7, is in abutment against the cam face of a cam 11 similar to the cam 10, so that the stopper 7 is reciprocated in the fetching direction Y1 by transmitting the drive force of a stepping motor or the like to a shaft 11*a* to rotate the cam 11. An abutment member 35, as extended from the push member 8, is in abutment against with the cam face of a cam 12 similar to the cam 10, so that the push member 8 is reciprocated in the discharge direction X2 by transmitting the drive force of a stepping motor or the like to a shaft 12*a* to rotate the cam 12. By controlling the rotations of the motors, the positions of the stoppers 6 and 7 and the push member 8 can be adjusted. These moving mechanisms are so arranged under the sheet pedestal 5 that they may not obstruct the sheet accommodations. The sheet pedestal 5 is, therefore, provided with openings 13 to 15 for admitting the protrusions of the stoppers 6 and 7 and the push member 8.

The sheets S1 from the first image forming unit 3 are registered in abutment against the stopper 6 arranged in position, and the sheets S2 from the second image forming unit 4 are registered in abutment against the stopper 7 arranged in position, so that the registrations can be made according to the sheet sizes. The push member 8 is usually arranged in such an escape position outside of the sheet pedestal 5 that the sheets S are fetched. The accommodated sheets S are discharged to the tray 9 by moving the push member 8 toward the inside of the sheet pedestal 5, and the push member 8 is arranged again in the escape position after the sheet discharge. Thus, the sheet accommodating and discharging actions are repeated.

Here, the moving mechanisms for the stoppers 6 and 7 and the push member 8 should not be limited to those of this embodiment but can adopt any ones if the mechanisms can be moved in the aforementioned manners.

In relation to the post-processing apparatus 2, moreover, the sheet pedestal 5 can be inclined to accommodate the individual sheets in registration. With reference to FIG. 3, here will be described the inclining mechanism for the sheet pedestal 5. The sheet pedestal 5 is equipped on its side faces 5*a* to 5*d* with pins 16 to 19, respectively. These pins: 16 and 17; and 18 and 19, as mounted on the individually confronting faces: 5*a* and 5*b*; and 5*c* and 5*d* are aligned with each other. The pins 16 and 17 on the side faces 5*a* and 5*b* are disposed at the sheet fetching side end portions of the first image forming unit 3. The pins 18 and 19 on the side faces 5*c* and 5*d* are disposed at the sheet fetching side end portions of the second image forming unit 4. With these pins 16 to 19, respectively, there are made engageable bearings 20 to 23. These bearings 20 to 23 are connected to the not-shown sheet accommodating apparatus body.

The sheet pedestal 5 can be inclined into a first mode, wherein its downstream side end portion (as located at the side face 5*d* confronting the side face 5*c*), as taken in the fetching direction X1, is at a higher level than its upstream side end portion (as located at the side face 5*c*), and a second mode wherein its downstream side end portion (as located at the side face 5*b* confronting the side face 5*a*), as taken in the fetching direction Y1, is at a higher level than its upstream side end portion (as located at the side face 5*a*).

Figure 7:
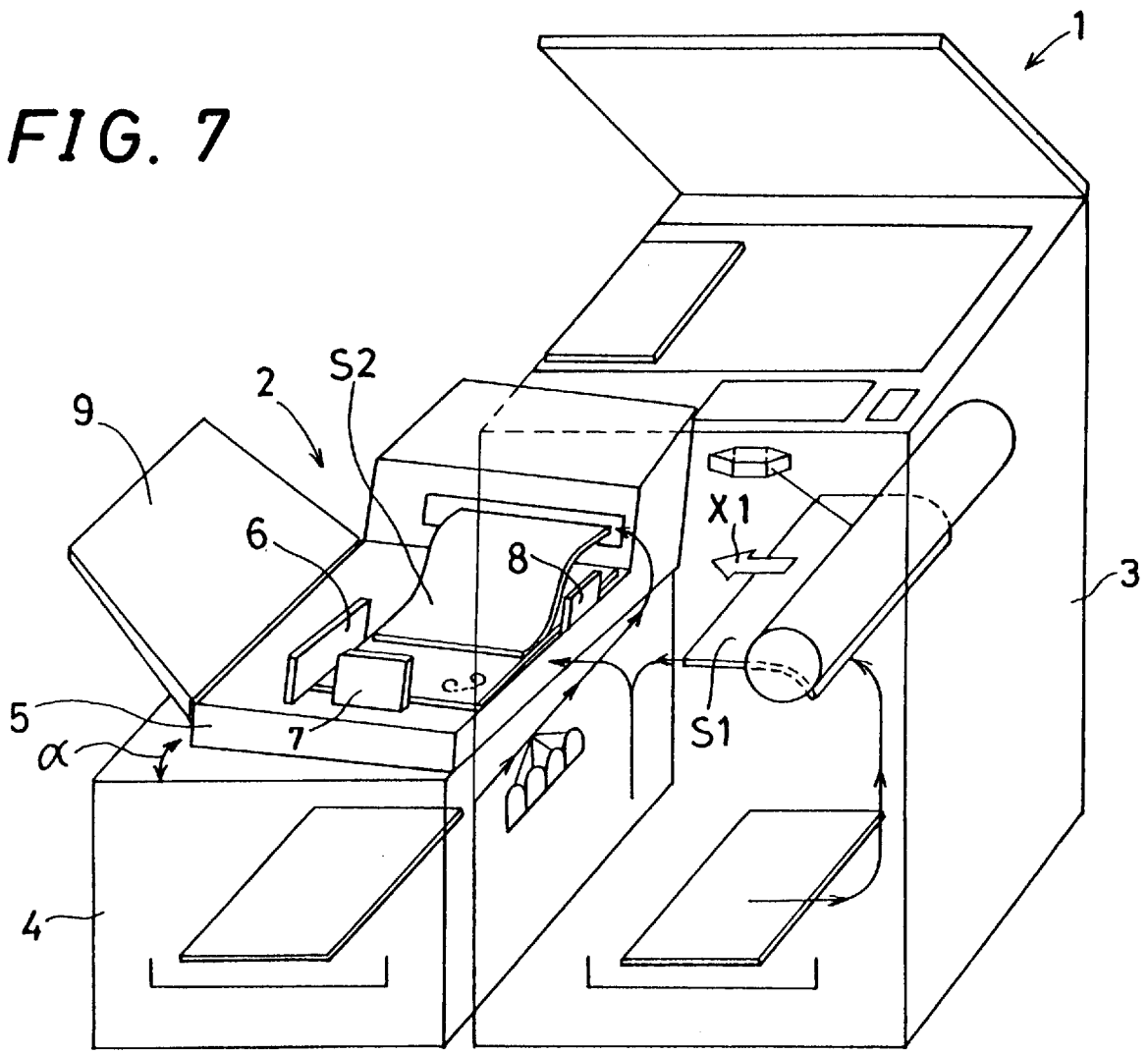
FIG. 7 is a perspective view showing a state in which the sheet pedestal 5 is inclined to a first mode.

In the first mode, more specifically, the bearings 20 and 21 are brought into respective engagements with the pins 16 and 17. By the drive force of the stepping motor or the like to the bearings 20 and 21 through the gears, moreover, the pins 16 and 17 are rotated to incline the sheet pedestal 5 into the position of the first mode. By controlling the rotation of the motor, the angle $\alpha$ of inclination of the sheet pedestal 5 can be adjusted with respect to a predetermined horizontal direction H. By thus inclining the sheet pedestal 5 into the first mode, as shown in FIG. 7, the sheets S can be accommodated in registration in the sheet pedestal 5 at the sheet fetching side of the first image forming unit 3. Here, FIG. 7 simplifies the construction of the complex image forming system 1, which is constructed, as shown in FIG. 1.

In the second mode, likewise, the bearings 22 and 23 are brought into respective engagements with the pins 18 and 19. By the drive force of the stepping motor or the like to the bearings 22 and 23 through the gears, moreover, the pins 18 and 19 are rotated to incline the sheet pedestal 5 into the position of the second mode. By controlling the rotation of the motor, the angle $\beta$ of inclination of the sheet pedestal 5 can be adjusted to a desired value with respect to the predetermined horizontal direction H. By thus inclining the sheet pedestal 5 into the second mode, the sheets S can be accommodated in registration in the sheet pedestal 5 at the sheet fetching side of the second image forming unit 4.

Here, the inclination of the sheet pedestal 5 may be switched between the first mode and the second mode in accordance with the sheet discharging actions of the first and second image forming units 3 and 4. Specifically, an inclination switching circuit is provided for switching the engagements between those of the bearings 20 and 21 with the pins 16 and 17 and those of the bearings 22 and 23 with the pins 18 and 19. As a result, the sheets S1 can be accommodated, when fetched from the first image forming unit 3, by inclining the sheet pedestal 5 into the first mode, and the sheets S2 can be accommodated, when fetched from the second image forming unit 4, by inclining the same into the second mode.

Moreover, the inclining mechanisms for the sheet pedestal 5 should not be limited to those of this embodiment but can adopt any ones if the mechanisms can be inclined in the aforementioned manners.

Figure 8:
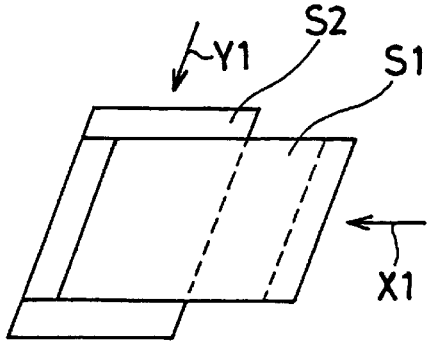
FIG. 8 is a diagram showing a state in which the sheets are irregularly accommodated.

In relation to the post-processing apparatus 2, moreover, at least the sheet pedestal 5 can be turned in the horizontal direction H. As a result, the individual sheets S from the first and second image forming units 3 and 4 can be so accommodated that the images formed thereon are arranged in the common direction. When the sheets S having different lengths and widths are to be discharged in the common or longitudinal direction from the first and second image forming units 3 and 4, on the other hand, the accommodate sheets S are not registered, as shown in FIG. 8. However, the sheets can be arranged in the common direction by turning the sheet pedestal 5.

The turning mechanism for the sheet pedestal 5 will be described with reference to FIG. 4. This turning mechanism can be exemplified by that which has been disclosed in Japanese Unexamined Patent publication JP-A2-86498 (1990). The turning mechanism is so arranged under the sheet pedestal 5 as to raise no obstruction to the sheet accommodations. Generally at the center of the sheet pedestal 5, there is arranged a stepping motor 24, the shaft of which is fixed on the bottom of the sheet pedestal 5 by a fixing member 25. The motor 24 is fixed on the not-shown sheet accommodating apparatus body by a support member 26. As the motor 24 is activated, the sheet pedestal 5 is turned in the horizontal direction H.

By controlling the rotation of the stepping motor 24, the turning stroke of the sheet pedestal 5 can be adjusted. When the fetching directions X1 and Y1 are perpendicular to each other, as in this embodiment, the individual sheets S can be so accommodated by turning at least the sheet pedestal 5 by 90 degrees that their image forming directions and their own directions are aligned.

Here, the turning direction of the sheet pedestal 5 may be changed in accordance with the actions to discharge the sheets from the first and second image forming units 3 and 4. Specifically, a turning direction switching circuit is provided for changing the rotating direction of the stepping motor 24. As a result, the individual sheets S can be so continuously fetched and accommodated efficiently with a short turning stroke that the image forming directions and the own directions of the individual sheets S from the image forming unit 3 and 4 are aligned.

Moreover, the turning mechanism for the sheet pedestal 5 should not be limited to that of this embodiment but can adopt any one if the mechanism can turn in the aforementioned manners.

Moreover, the post-processing apparatus 2 is enabled to post-process the accommodated sheets S in a predetermined manner so that the fetched sheets S are post-processed and discharged from the sheet pedestal 5. In this embodiment, the post-processing is exemplified by a stapling operation for stapling the sheets. With reference to FIG. 5, here will be described a stapling mechanism. This stapling mechanism can be exemplified by that which has been disclosed in Japanese Unexamined Patent Publication JP-A 64-43457 (1989).

In the sheet pedestal 5, there is formed a cut-away portion 27 for exposing the accommodated sheets S partially to the outside. A stapler 28, as constructing the stapling mechanism, is equipped with an upper stapling portion 29 and a lower stapling portion 30, between which the sheets S are sandwiched and stapled. The stapler 28 is fixed on the not-shown sheet accommodating apparatus body. Moreover, the stapler 28 is biased at all times by a spring 31 so that it is arranged in a predetermined escape position (as indicated by solid lines) while it is not performing the stapling action. In this escape position, the sheets S are not sandwiched between the stapling portions. The stapler 28 is connected with a solenoid 32 so that it is arranged it is arranged in a predetermined stapling position (as indicated by doubledotted lines) when the solenoid 32 is turned ON. In this stapling position, the sheets S are sandwiched between and stapled by the stapling portions 29 and 30. After the end of this stapling action, the stapler 28 is arranged again in the escape position by turning OFF the solenoid 32.

Here, the stapling mechanism for the sheets should not be limited to that of this embodiment but can adopt any one if the mechanism can staple in the aforementioned manners.

Reverting to FIG. 1, here will be described the complex image forming system 1 including the post-processing apparatus 2 for fetching and accommodating both the sheets which have the images formed by the different image forming units 3 and 4. Over one side face 3*a* of the first image forming unit 3, there is formed an exit 36 for discharging therethrough the sheets S1 having the images formed by the unit 3. Over the upper face 4*a* of the second image forming unit 4, there is formed an exit 37 for discharging the sheets S2 having the images formed by the unit 4. The first image forming unit 3 is given a larger height hi than that h2 of the second image forming unit 4. This second image forming unit 4 is arranged at the side of the side face 3*a* of the first image forming unit 3, and the post-processing apparatus 2 is arranged over the second image forming unit 4. By this arrangement, the sheets from the individual image forming units 3 and 4 can be fetched within the limited space into the post-processing apparatus 2 so that the system 1 can be small-sized.

Moreover, the first image forming unit 3 can be realized by one for forming monochromatic images whereas the second image forming unit 4 is realized by one for forming color images, and both the sheets S1 having the monochromatic images formed by the first image forming unit 3 and the sheets S2 having the color images formed by the second image forming unit 4 can be fetched and accommodated. In this embodiment, more specifically, the first image forming unit 3 is exemplified by a laser dot type monochromatic digital electrophotographic copying machine, and the second image forming unit 4 is exemplified by an ink jet printing type color printer.

The copying machine, as employed as the first image forming unit 3, is an ordinary one for reading out the image, as drawn on a document 55 placed on a transparent reading desk 56, to form the image on the sheets S1, as fed from a sheet feeder 57, and to discharge the sheets to the outside. The copying machine is given a function to print the image signals received from an external device such as a facsimile or computer. Considering the copying speed, the sheets S1 having a size A4, for example, are usually conveyed in the latitudinal direction. The printer, as employed as the second image forming unit 4, is also an ordinary one for forming an image on the sheets S2, as fed from a sheet feeder 58, with the image signals received from an external device such as a computer, to turn and discharge the sheets. For these image formations, there can be employed an ink jet recording head, as disclosed in Japanese Unexamined Patent Publication JP-A 3-266644(1991). In order to reduce the transverse movement and the width of the head, the sheets S2 of a size A4 are usually conveyed in the longitudinal direction. This complex image forming system 1 can achieve image qualities and image forming efficiencies equivalent to those of the system employing only the digital color copying machine, at a low cost.

Figure 9:
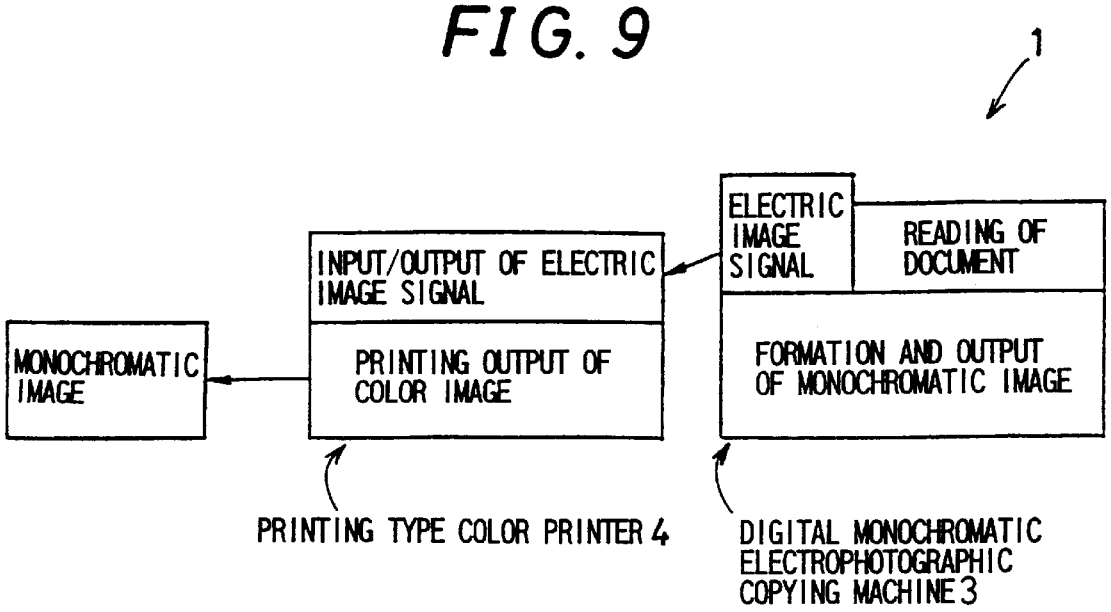
FIG. 9 is a diagram showing flows of image signals in the complex image forming system 1.

In this embodiment, moreover, as shown in FIG. 9, the first image forming unit 3 forms an image with the image signals it reads out, and these image signals are fed to the second image forming unit 4 to form an image with the image signals. As a result, the second image forming unit 4 can form the image unless it is connected with a computer or the like, so that the system construction can be simplified.

Here, the first image forming unit 3 may be realized by an analog type electrophotographic copying machine to form the monochromatic images, whereas the second image forming unit 4 may be realized by a digital type laser beam electrophotographic color printer to form the color or monochromatic images with the image signals coming from the computer or the like. Alternatively, the first image forming unit 3 may be realized by an analog type electrophotographic copying machine to form the monochromatic images, whereas the second image forming unit 4 may be realized by a printing type printer to form the color or monochromatic images with the image signals coming from the computer or the like. These complex image forming systems are excellent in the image qualities and the image forming efficiencies and can be realized at a lower cost.

Figure 10:
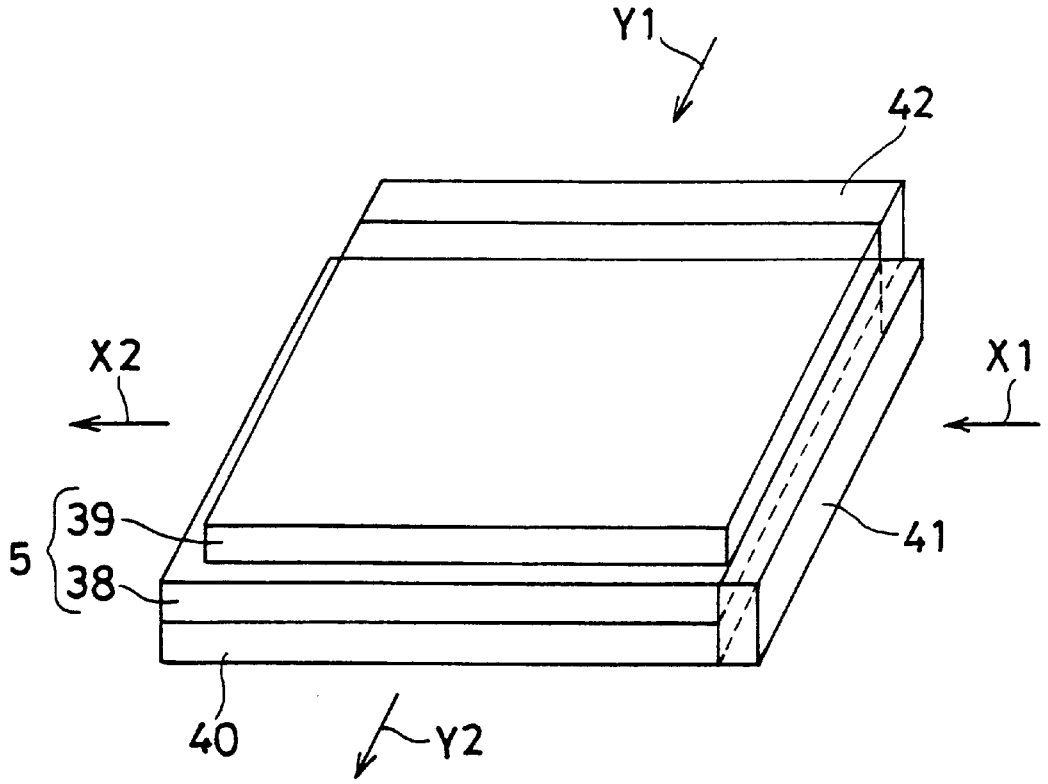
FIG. 10 is a perspective view showing another example of the inclining mechanism for the sheet pedestal 5.
Figure 11A:
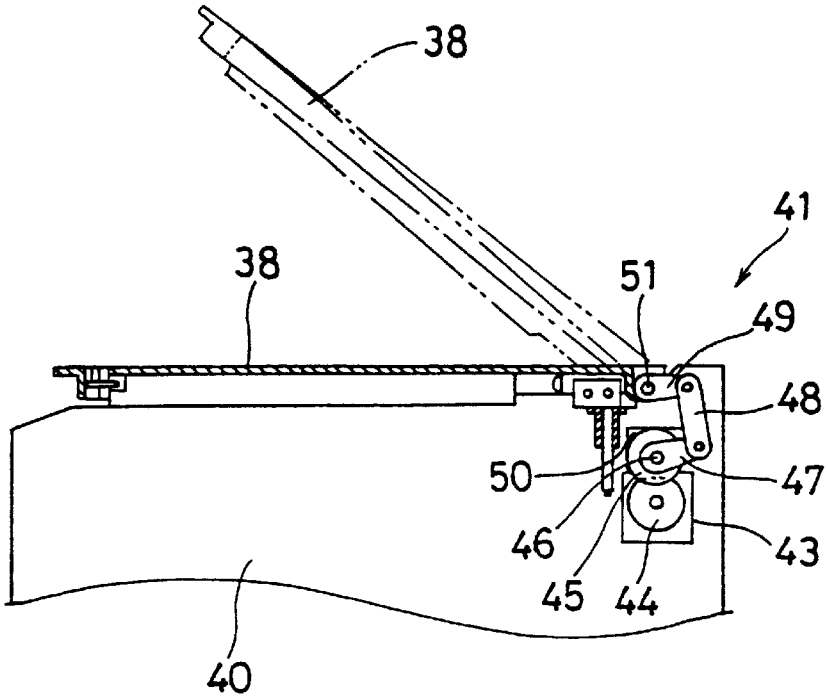
FIGS. 11A and 11B are a section and a top plan view showing a portion of the another inclining mechanism.
Figure 11B:
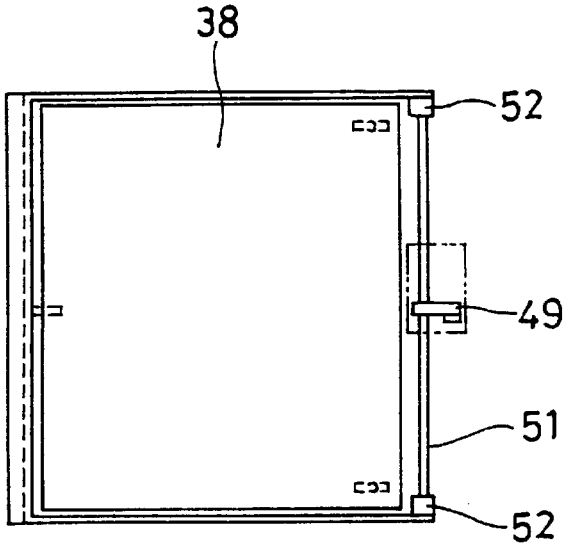
Figure 12:
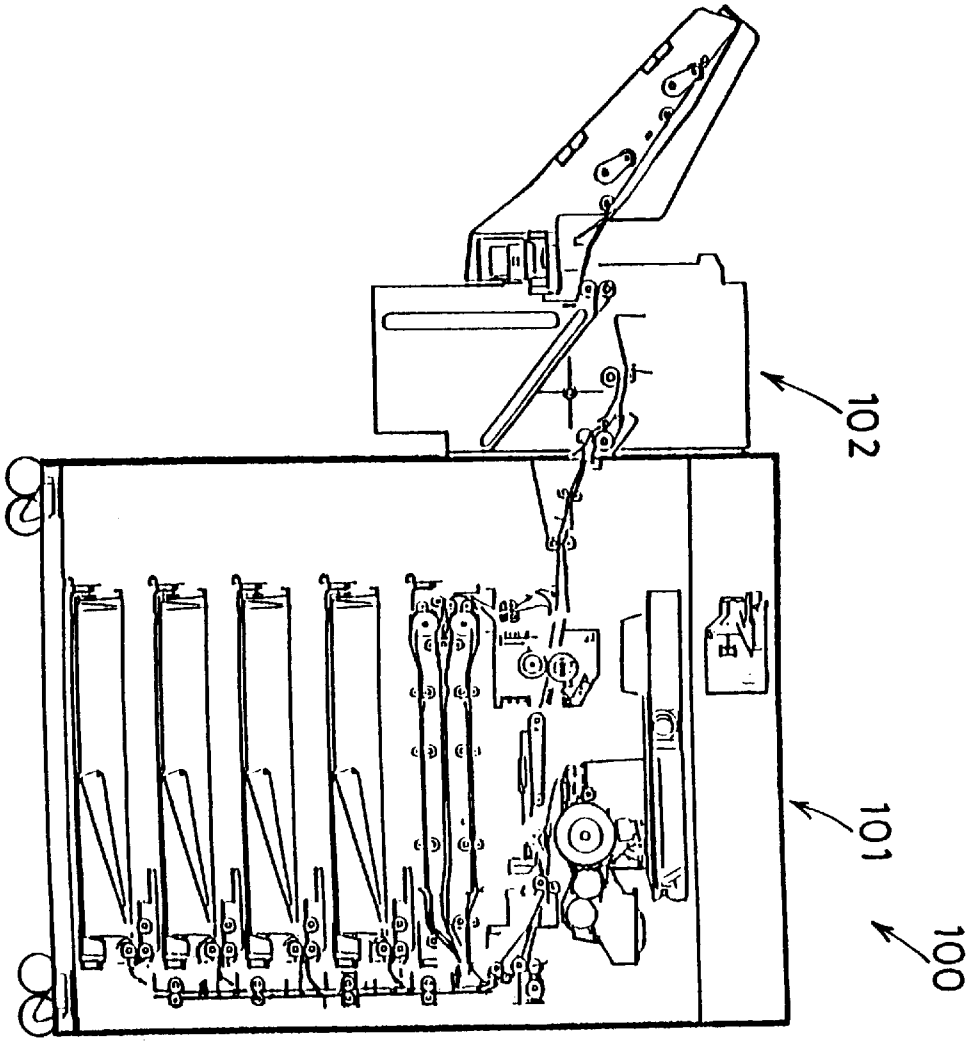
FIG. 12 PRIOR ART
FIG. 12 is a diagram showing an image forming system 100 according to the prior art.

FIG. 10 is a perspective view showing another example of the inclining mechanism for the sheet pedestal 5, and FIG. 11A and 11B are a section and a top plan view showing a portion of the inclining mechanism. The inclining mechanism is exemplified by that which has been disclosed in Japanese Unexamined Patent Publication JP-A 57-29059 (1982). The sheet pedestal 5 is constructed to include a first desk member 38 and a second desk member 39 stacked on the first member 38 but made smaller than the first member 38. This first desk member 38 jointed at the side of the fetching direction X1 to a body 40 of the post-processing apparatus 2 by a first inclining member 41, and the second desk member 39 is jointed at the side of the fetching direction Y1 exclusively to the first desk member 38 by a second inclining member 42.

The first inclining member 41 is equipped, as shown in FIGS. 11A and 11B, with a motor 43 which is fixed on the body 40. A gear 44, as mounted on the output shaft of the motor 43, meshes with a gear 45. This gear 45 has a pivot 46, on which a crank 47 is fixed. On a pivot 51 engaging with a bearing 52 of the first desk member 38, there is fixed a crank 49. These cranks 47 and 49 are connected through a link 48. The pivot 46 of the gear 45 is connected to the gear 45 through a clutch 50 so that it is switched between the connected state and the disconnected state by the clutch 50. By activating the motor 43 in the connected state, the second desk member 39 can be inclined together with the first desk member 38 with respect to the body 40 thereby to establish the first mode. By constructing the second inclining member 42 like the first inclining member 41, the second desk member 39 can be inclined with respect to the first desk member 38 thereby to establish the second mode. This inclining mechanism may be adopted in place of the inclining mechanism for the sheet pedestal 5, as shown in FIG. 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet accommodating apparatus comprising:

a sheet accommodation portion for fetching sheets which are discharged from a first image forming unit, in one direction, and for fetching sheets which are discharged from a second image forming unit, in another direction different from the one direction.

2. The sheet accommodating apparatus of claim 1, wherein the sheet accommodation portion accommodates a plurality of sheets in a stack.

3. The sheet accommodating apparatus of claim 1, wherein the one fetching direction and the another fetching direction are perpendicular to each other.

4. The sheet accommodating apparatus of claim 1, further comprising:

one registration member arranged in a direction perpendicular to the one fetching direction; and the other registration member arranged in a direction perpendicular to the other fetching direction, wherein both the one and the other registration members are arranged so as to protrude from a sheet placing face of the sheet accommodation portion.

5. The sheet accommodating apparatus of claim 4, further comprising:

moving means for moving the one registration member in the one fetching direction and the other registration member in the another fetching direction.

6. The sheet accommodating apparatus of claim 1, further comprising discharge means for discharging the accommodated sheets from the sheet accommodation portion.

7. The sheet accommodating apparatus of claim 6, wherein the discharge means Includes a sheet push member arranged so as to protrude from the sheet placing face of the sheet accommodation portion and to be movable in the one or the other fetching direction.

8. The sheet accommodating apparatus of claim 1, further comprising inclination means for inclining the sheet accommodation portion.

9. The sheet accommodating apparatus of claim 8, wherein the inclination means can incline the sheet accommodation portion into a first mode or a second mode, the first mode being an inclination mode in which the downstream side end portion, as taken in the one fetching direction, is at a higher level than the upstream side end portion, and the second mode being an inclination mode in which the downstream side end portion, as taken in the another fetching direction, is at a higher level than the upstream side end portion.

10. The sheet accommodating apparatus of claim 9, further comprising an inclination switching circuit for switching the inclination of the sheet accommodation portion by the inclination means between the first mode and the second mode in accordance with the discharging actions of the sheets from the first and the second image forming units.

11. The sheet accommodating apparatus of claim 1, further comprising turning means for turning at least the sheet accommodation portion of the sheet accommodating apparatus in a horizontal direction.

12. The sheet accommodating apparatus of claim 11, wherein the turning means turns at least the sheet accommodation portion by 90 degrees.

13. The sheet accommodating apparatus of claim 11 or 12, further comprising a turning direction switching circuit for switching a turning direction of at least the sheet accommodation portion by the turning means, in accordance with the discharging actions of the sheets from the first and the second image forming units.

14. The sheet accommodating apparatus of claim 1, further comprising post-processing means for post-processing the sheets, as accommodated in the sheet accommodation portion, in a predetermined manner.

15. The sheet accommodating apparatus of claim 14, wherein the post-processing apparatus means is a stapler for stapling the sheets accommodated in the sheet accommodation portion.

16. A complex image forming system comprising:

first and second image forming units for forming images on predetermined sheets and for discharging the sheets; and a sheet accommodating apparatus according to any of claims 1 to 15.

17. The complex image forming system of claim 16, wherein the first image forming unit is provided on an upper portion of a side face thereof with an exit for discharging the sheets having the formed images, the second image forming unit is provided in the upper face thereof with an exit for discharging the sheets having the formed images, the first image forming unit has a height selected to be larger than that of the second image forming unit, and the second image forming unit is arranged at the side having the exit of the first image forming unit whereas the sheet accommodating apparatus is arranged over the second image forming unit.

18. The complex image forming system of claim 16, wherein the first image forming unit forms a monochromatic image whereas the second image forming unit forms a color image.

19. The complex image forming system of claim 16, wherein the first image forming unit is realized by an analog type electrophotographic copying machine whereas the second image forming unit is realized by a digital type laser beam electrophotographic color printer.

20. The complex image forming system of claim 16, wherein the first image forming unit is realized by an analog type electrophotographic copying machine whereas the second image forming unit is realized by a printing type printer.

21. The complex image forming system of claim 16, wherein the first image forming unit is realized by a digital type electrophotographic copying machine whereas the second image forming unit is realized by a printing type color printer.

22. The complex image forming system of claim 21, wherein the first image forming unit forms an image with image signals read thereby, and the image signals read by the first image forming unit are fed to the second image forming unit so that the second image forming unit forms an image with the image signals.

* * * * *